US005427170A

United States Patent [19]

Arakawa et al.

[11] Patent Number: 5,427,170

[45] Date of Patent: Jun. 27, 1995

[54] VACUUM CASTING APPARATUS AND METHOD

[75] Inventors: Yasuyuki Arakawa; Tamotsu Hasegawa, both of Nagoya; Atushi Ota, Toyota; Minoru Uozumi, Aichi, all of Japan

[73] Assignee: Toyota Jidosha Kabushiki Kaisha, Toyota, Japan

[21] Appl. No.: 272,160

[22] Filed: Jul. 8, 1994

[30] Foreign Application Priority Data

Jul. 9, 1993 [JP] Japan ..... 5-170371

[51] Int. Cl.[6] ..... B22D 18/02; B22D 18/04

[52] U.S. Cl. ..... 164/63; 164/119; 164/120; 164/254; 164/306

[58] Field of Search ..... 164/63, 119, 120, 254, 164/306, 309

[56] References Cited

U.S. PATENT DOCUMENTS 1,697,741 1/1929 Vaughan .

FOREIGN PATENT DOCUMENTS 60-102257 6/1985 Japan .
61-182868 8/1986 Japan .
62-16858 1/1987 Japan .
2-155557 6/1990 Japan .
3-31058 3/1991 Japan .
3-68955 7/1991 Japan .
3-198969 8/1991 Japan .
4-158968 6/1992 Japan .
4-274860 9/1992 Japan .
5-123845 5/1993 Japan .
5-146863 6/1993 Japan .
5-146864 6/1993 Japan .
5-146865 6/1993 Japan .
5-169232 7/1993 Japan .
5-63264 9/1993 Japan .
1360887 12/1987 U.S.S.R. ..... 164/119
WO93/07977 4/1993 WIPO ..... 164/63

OTHER PUBLICATIONS

Patent Abstract of Japan No. 5-192759 published Aug. 3, 1993.

*Primary Examiner*—J. Reed Batten, Jr.
*Attorney, Agent, or Firm*—Cushman, Darby & Cushman

[57] ABSTRACT

A vacuum casting apparatus includes a plurality of pressure pins arranged in a molding cavity, and at least one pressure pin is located in a portion of the molding cavity farthest from a gate. The pressure pins are operated to pressurize the molding cavity in an order from the pressure pin located farthest from the gate to a pressure pin located nearest to the gate. A cross-sectional area reduced portion can also be formed in a portion of a runner connecting the molding cavity and the molten metal retaining dome. A molten metal in the molding cavity is thereby suppressed from flowing backward into the molten metal retaining dome when being pressurized by the pressure pins, so that the quality of the cast products is improved.

11 Claims, 4 Drawing Sheets

VACUUM CASTING APPARATUS AND METHOD

BACKGROUND OF THE INVENTION

1. Field of the Invention

The present invention relates to a vacuum casting apparatus and method wherein a molding cavity is reduced in pressure to a vacuum and upon opening a gate, a molten metal is charged from a molten metal retaining dome into the molding cavity at a high speed. More particularly, the present invention relates to a vacuum casting apparatus and method wherein the molten metal charged into the molding cavity is pressurized before it is solidified and during pressurization the molten metal is prevented from flowing backward toward the molten metal retaining dome.

2. Description of Related Art

As one example of a vacuum casting apparatus and method capable of producing cast products of a high quality and at a low cost, a casting apparatus and method wherein a molding cavity is reduced in pressure substantially to a vacuum and then a molten metal is charged into the molding cavity was proposed by the present applicant in Japanese Patent Publication HEI 2-155557.

The proposed casting apparatus includes a molding cavity which can be reduced in pressure substantially to a vacuum, a molten metal supply passage, a gate piston for opening and closing a passage connecting the molten metal supply passage to the molding cavity, and a pressure pin assembled in the gate piston. In the casting apparatus, the molding cavity is reduced in pressure to a vacuum. Then, the gate piston is opened so that a molten metal is charged through the molten metal supply passage into the molding cavity at a high speed. The gate is then closed to isolate the molding cavity filled with the molten metal from the molten metal retaining dome, and then the pressure pin is operated to pressurize the molten metal in the molding cavity, to solidify the molten metal quickly. In the molding, since the molding cavity is in a vacuum, involvement of air by the molten metal is prevented, so that casting defects due to bubbles are avoided. Further, since the charging speed is high, running of the molten metal in the molding cavity is improved and a production of slimmer casting products is possible.

However, the following problems yet remain in the above-described vacuum casting apparatus and method:

When the gate piston is closed to isolate the molding cavity from the molten metal retaining dome, a clearance inevitably remains between the molding die and the gate piston moved relative to the die. Further, pressurization of the molten metal in the molding cavity must be initiated within a short period of time after the gate piston has been closed, because if the pressurization occurs too late the molten metal would be allowed to solidify and a sufficient pressurization would not produce advantageous results. Due to these reasons, when the molten metal in the molding cavity is pressurized by the pressure pin, a portion of the molten metal will flow backward toward the molten metal retaining dome to cause an insufficient pressurization and molding defects.

SUMMARY OF THE INVENTION

An object of the present invention is to provide a vacuum casting apparatus and method wherein a molten metal charged into a molding cavity is prevented from flowing backward when it is pressurized by a pressure pin after the molding cavity has been closed.

The above-described object is achieved in accordance with the present invention which is described hereinbelow with reference to a first, second, and third embodiment.

A vacuum casting apparatus is provided which includes a molding cavity which can be reduced in pressure substantially to a vacuum, and a molten metal retaining dome. A gate is provided to allow the molten metal in the molten metal retaining dome to be charged into the molding cavity which has been reduced in pressure substantially to a vacuum, upon being opened. At least one pressure means is provided to the molding cavity, for pressurizing the molten metal which has been charged into the molding cavity, while at least one of the pressure means being located at or in the vicinity of a portion of the molding cavity farthest from the gate.

A vacuum casting method is also provided which includes the step of shutting a gate to isolate a molding cavity from an interior of a molten metal retaining dome which communicates with a molten metal holding furnace via a hollow stalk. The method also includes the steps of reducing a pressure in the molding cavity substantially to a vacuum, and raising a portion of the molten metal held in the molten metal holding furnace into the molten metal retaining dome. The gate is then opened to charge the molten metal in the molten metal retaining dome into the molding cavity. At least one shut pin or a gate is shut to isolate the molding cavity filled with the molten metal from the molten metal retaining dome. A plurality of pressure means which are spaced at various distances from the gate are operated to pressurize the molten metal in the molding cavity. The plurality of pressure means are operated with a time differential to one another such that pressure means located farther from the gate is operated earlier than pressure means located nearer to the gate. The molten metal in the molding cavity is then allowed to solidify.

A vacuum casting apparatus is provided which includes a molding cavity which can be reduced in pressure substantially to a vacuum. The apparatus further includes a molten metal retaining dome and a gate for allowing the molten metal in the molten metal retaining dome to be charged into the molding cavity which has been reduced in pressure substantially to a vacuum. A runner connects an interior of the molten metal retaining dome to the molding cavity, the runner including a cross-sectional area reduced portion.

In the vacuum casting apparatus of the present invention, when the molten metal in the molding cavity is pressurized, the molten metal is prevented from flowing backward to the molten metal retaining dome, because there is a relatively large distance between the pressure means and the molten metal retaining dome and therefore the reverse flow will receive a large flow resistance. As a result, the molten metal is sufficiently pressurized, and the quality of the casting product is improved.

in the vacuum casting method of the present invention, because the plurality of pressure means are operated in the order from the pressure means located farthest from the gate to the pressure means nearest to the gate, the passage flow resistance between the farthest pressure means and the gate is large, so that the molten metal is unlikely to flow backward. Accordingly, it is allowed to begin pressurizing before the molding cavity is completely shut off, so that the period of time between charging of the molten metal into the molding cavity and the beginning of pressurization can be shortened. As a result, the molten metal can be pressurized in an early stage of the solidification of the molten metal so that the molten metal is sufficiently pressurized and so that the quality of the casting products is improved.

In the vacuum casting apparatus of the present invention, the cross-sectional area reduced portion of the runner suppresses the molten metal in the molding cavity from flowing backward, so that the molten metal in the molding cavity can be effectively pressurized and therefore so that the quality of the casting product is improved.

BRIEF DESCRIPTION OF THE DRAWINGS

The above and other objects, features, and advantages of the present invention will become more apparent and will be more readily appreciated from the following detailed description of the preferred embodiments of the invention taken in conjunction with the accompanying drawings, in which.

DETAILED DESCRIPTION OF THE PREFERRED EMBODIMENTS

Figure 5:
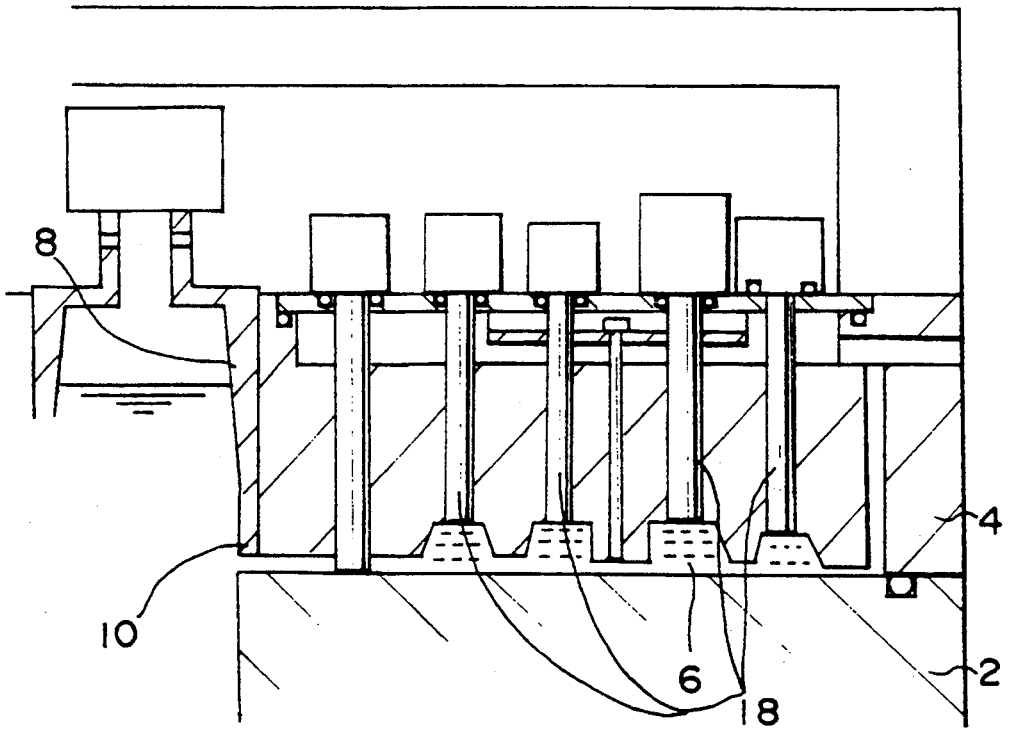
FIG. 5 is a partial cross-sectional schematic view of a vacuum casting apparatus in accordance with a first embodiment of the present invention.
Figure 6:
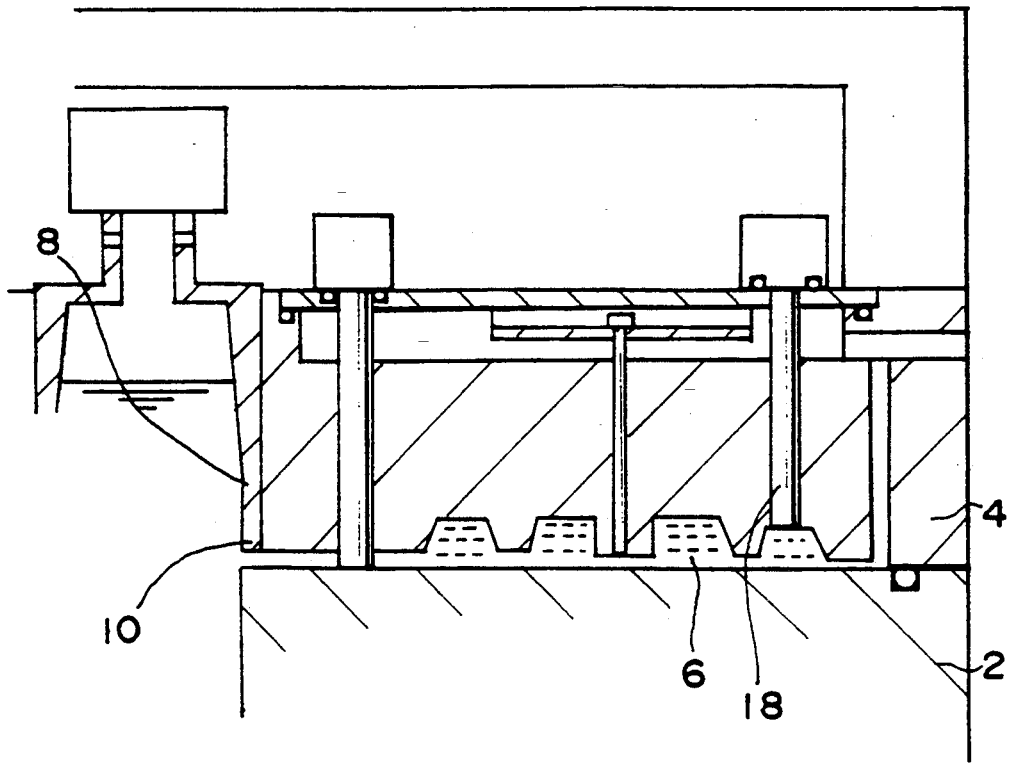
FIG. 6 is a partial cross-sectional schematic view of a casting apparatus for conducting a vacuum casting method in accordance with a second embodiment of the present invention.
Figure 7:
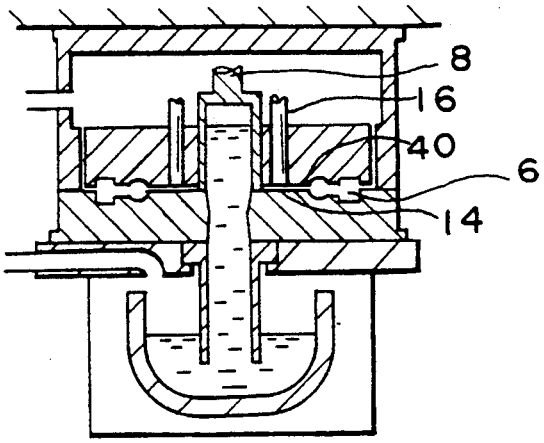
FIG. 7 is a cross-sectional schematic view of a casting apparatus in accordance with a third embodiment of the present invention.

FIGS. 1–4 illustrate structures and operation common to all of the embodiments of the present invention. FIG. 5 illustrates the first embodiment, FIG. 6 illustrates the second embodiment, and FIGS. 7–12 illustrate the third embodiment of the present invention, respectively.

First, structures and operation common to all of the embodiments of the present invention will be explained with reference to FIGS. 1–4. The vacuum casting apparatus of the present invention does not require the conventional high pressure casting or conventional die casting molten metal injection mechanism. Thus, the apparatus of the present invention is much simpler than the conventional apparatus.

The vacuum casting apparatus of the present invention is provided with a gate for shutting off the molding cavity and a pressure reducing mechanism for reducing a pressure in the molding cavity, so that the molding cavity can be charged with a molten metal at a high speed using a pressure difference between the vacuum generated in the molding cavity and the atmospheric pressure retained in the molten metal retaining dome.

More particularly, a molding die assembly which includes an upper die 2 and a lower die 4 is capable of being opened and closed by moving the upper die 2 relative to the lower die 4 in a vertical direction. The upper die 2 and the lower die 4 define at least one molding cavity 6 therebetween. In the embodiment of FIGS. 1–4, a plurality of molding cavities 6 are arranged around a molten metal retaining dome 8, which is located at a central portion of the molding die assembly, and extend radially. The molding cavity 6 can be shut off or isolated from the interior of the molten metal retaining dome 8 by a gate 10 which is formed at a lower end of the molten metal retaining dome 8. The molding cavity 6 is connected to a pressure reducing pump (not shown) via a suction port 26 and can be reduced in pressure to a vacuum after the molding die assembly is closed and the molding cavity 6 is shut off from the molten metal by the gate 10.

The molten metal retaining dome 8 communicates with a molten metal holding furnace 22 via a sprue 12 formed in the lower die 4 and a stalk 20 connecting the sprue 12 to the molten metal holding furnace 22. The molten metal holding furnace 22 is housed in a closed chamber, and a pressure of an interior of the closed chamber can be controlled by a pressure pump (not shown) connected to the closed chamber via a pressure port 28. When the pressure of the interior of the closed chamber is increased and the increased pressure acts on a free surface of the molten metal 24 (for example, molten aluminum alloy) held in the molten metal holding furnace 22, a portion of the molten metal 24 held in the molten metal holding furnace 22 is raised into the molten metal retaining dome 8.

A shut pin 16 is provided to a runner 14 connecting the interior of the molten metal retaining dome 8 and the molding cavity 6. The molding cavity 6 is shut off or isolated from the interior of the molten metal retaining dome 8 when the shut pin 16 is in a shut position, and allows the molding cavity 6 to communicate with the interior of the molten metal retaining dome 8 when in an opened position. A pressure pin 18 movable relative to the upper die 2 is provided in communication with the molding cavity 6, and the molten metal charged into the molding cavity 6 can be pressurized by inserting the pressure pin 18 into the molding cavity 6 before the molten metal in the molding cavity 6 is solidified.

Figure 1:
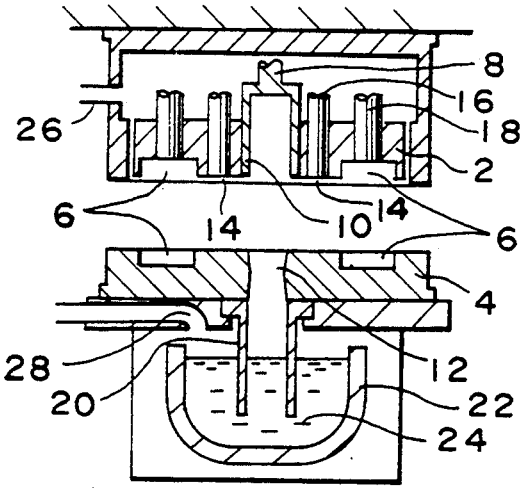
FIG. 1 is a cross-sectional schematic view of a casting apparatus in accordance with the present invention in a state where dies are open.
Figure 2:
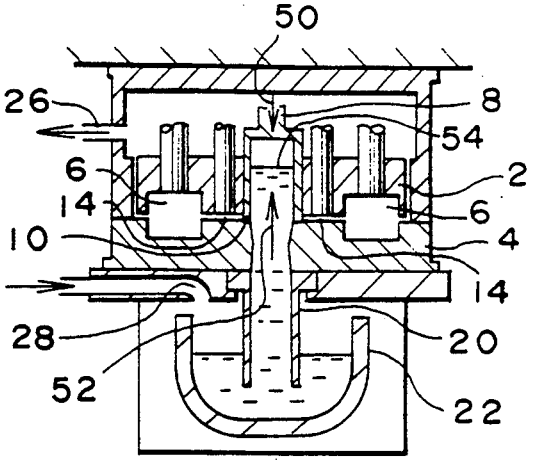
FIG. 2 is a cross-sectional schematic view of the apparatus of FIG. 1 in a state where the dies have been closed and a molding cavity has been reduced in pressure.

Using the above-described apparatus, a vacuum casting method of the invention is conducted as follows:

First, the molding die assembly is closed, by which the state of the casting apparatus shown opened in FIG. 1 is changed to a state shown closed in FIG. 2. Then, the molten metal retaining dome 8 is lowered in the direction of arrow 50 relative to the upper die 2, so that the gate 10 isolates the molding cavity 6 from the interior of the molten metal retaining dome 8 which communicates with the atmosphere. The molten metal retaining dome 8 is shown lowered in FIG. 2, with the gate 10 in a closed position which isolates the molding cavity from the interior of the molten metal retaining dome. Then, the molding cavity 6 is reduced in pressure to a vacuum by operating the pressure reducing pump connected to the molding cavity 6 via the suction port 26. The vacuum to be generated in the molding cavity 6 is higher than about 50 torr, and preferably higher than about 20 torr, and most preferably about 10 torr. A vacuum of between 50 and 100 torr is used in the conventional vacuum die casting. Therefore, the vacuum casting of the invention is distinguishable from the conventional vacuum die casting methods and apparatus. Casting products having as high a quality as that of those obtained by the conventional vacuum die casting methods performed at lower vacuums can be obtained at a vacuum higher than 20 torr in the method of the invention.

Substantially simultaneously with the reduction of the pressure in the molding cavity 6, the pressure acting on the free surface of the molten metal held in the molten metal holding furnace 22 is increased so that a portion of the molten metal 24 held in the furnace 22 is raised in the direction of arrow 52 in FIG. 2 into the molten metal retaining dome 8. The rising speed of a surface 54 of the molten metal in the stalk 20 and in the molten metal retaining dome 8 at a later stage of the rising motion of the molten metal is set at about 5 to 10 cm/sec. When an increase in the gas pressure acting on the molten metal held in the furnace 22 is stopped, the surface 54 of the molten metal in the molten metal retaining dome 8 may oscillate for a few seconds due to a cushion effect of the gas inside the closed chamber in which the furnace 22 is housed.

Figure 3:
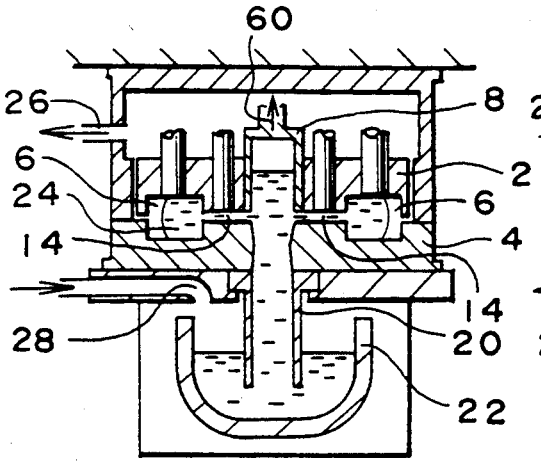
FIG. 3 is a cross-sectional schematic view of the apparatus of FIG. 1 in a state where a molten metal is charged into the molding cavity.

Then, as illustrated in FIG. 3, the gate 10 is opened by moving the molten metal retaining dome 8 in the direction of arrow 60 so that the molten metal 24 in the molten metal retaining dome 8 is charged into the molding cavity 6 at a high speed due to a pressure difference between the vacuum in the molding cavity 6 and the atmospheric pressure retained inside the molten metal retaining dome 8. The charging speed of the molten metal running in the molding cavity 6 is about 7 m/sec. Because of the pressure difference, this speed is much higher than the charging speed of the molten metal in the conventional low casting method, which is typically 0.5 m/sec. This high charging speed improves the running characteristic of molten metal in the molding cavity and allows thinner cast products to be formed. Though such a high speed is obtained in the conventional die casting, the molten metal tends to become involved with air and therefore have bubbles. Also, a hydraulic cylinder needs to be provided in the conventional die casting to push the molten metal at a large pressure. In contrast, in the vacuum casting method of the present invention, the molten metal does not become involved with air and therefore no bubbles are mixed in the molten metal charged into the molding cavity, due to the high vacuum generated in the molding cavity 6. The present invention thereby allows for the generation of few or no casting defects. Thus, the cylinder of the conventional die casting to push the molten metal at a large pressure does not need to be provided in the apparatus for conducting the method of the present invention.

Figure 4:
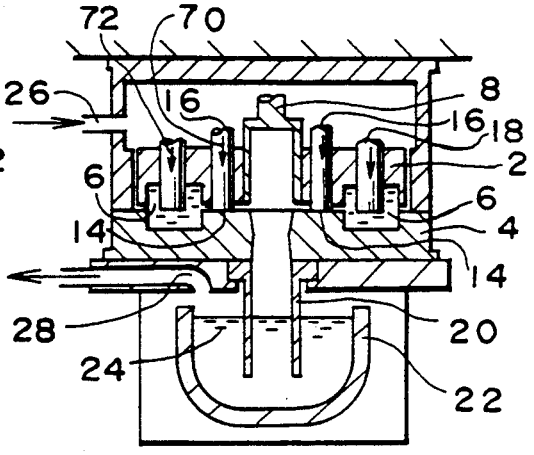
FIG. 4 is a cross-sectional schematic view of the apparatus of FIG. 1 in a state where the molding cavity has been closed and a pressure pin is operated.

Then, as illustrated in FIG. 4, the shut pin 16 is lowered in the direction of arrows 70 relative to the upper die 2 to shut the runner 14 and to isolate the molding cavity 6 filled with the molten metal from the interior of the molten metal retaining dome 8. Then, the vacuum pressure generated in the molding cavity 6 is released, and the pressure pin 18 is inserted into the molding cavity 6 filled with the molten metal in the direction indicated by arrow 72 to pressurize the molten metal retained in the molding cavity 6. Even if the molten metal includes vacuum porosities, the vacuum porosities will diminish and disappear when pressurized by the pressure pin 18. While the molten metal is pressurized by the pressure pin 18, the gas pressure acting on the molten metal 24 held in the molten metal holding furnace 22 is released. Then, the molten metal in the molding cavity 6 is cooled naturally or forcibly. After the molten metal has been solidified, the molding die is opened, and the cast product is taken out from the molding die. The inside surface of the molding die defining the molding cavity is then coated with a mold release agent and is prepared for the next molding cycle.

Next, structures and operation specific to a vacuum casting apparatus and an operation method thereof in accordance with each embodiment of the present invention will be explained.

With the first embodiment of the present invention, as illustrated in FIG. 5, at least one pressure pin 18 for insertion into the molding cavity 6 is located in a farthest portion of the molding cavity 6 from the gate 10. In the vacuum casting apparatus of Japanese Patent Publication HEI 2-155557, the pressure pin is provided in the gate itself, or in the vicinity thereof, or in a thick portion of the molding cavity. In contrast, in the vacuum casting apparatus in accordance with the first embodiment of the present invention, a pressure pin 18 is located at a portion of the molding cavity farthest from the gate 10, that is, at a portion lastly charged with the molten metal.

The molten metal in the molding cavity 6 is pressurized by inserting the pressure pin 18 into the molding cavity 6, substantially simultaneously with charging molten metal into the lastly charged portion with molten metal. That is, the lastly charged portion is the portion of the molding cavity farthest from the gate 10 and which is farthest from being isolated from the molding cavity 6 by the shut pin 16. Even if the pressurization begins before the molding cavity 6 has been completely isolated by the shut pin 16, the molten metal is prevented from flowing backward from the molding cavity 6 into the molten metal retaining dome 8 during pressurization, because the flow resistance between the pressurized portion and the gate 10 is large. Accordingly, by providing the pressure pin 18 in the portion of the molding cavity farthest from the gate 10 or in the vicinity thereof, a timing for pressurizing the molten metal in the molding cavity 6 can be determined earlier, so that the casting cycle can be shortened, and production efficiency can be improved. Further, the molten metal reaching the lastly charged portion has been decreased in temperature, and therefore the lastly charged portion is a portion where the molten metal is earliestly solidified. Thus, since the lastly charged portion can be pressurized earlier than in the conventional apparatus, the molten metal in the lastly charged portion can be pressurized sufficiently before the molten metal in this portion is almost solidified. As a result, casting defects can be avoided, and the quality of casting products is improved.

The temperature of the molten metal decreases when it flows in the molding cavity 6 and is also contaminated by dusts and mold release agents adhering to the inside surface of the die. By providing the pressure pin in the lastly charged portion of the molding cavity 6 and by providing the molding cavity 6 with a cavity portion (not shown) into which a contaminated tip portion of the running molten metal is pushed or overflown, an overflow effect will be obtained as well as the pressurization effect. Further, solidified metal pieces which adhered to the pressure pin 18 at the previous cycle may become involved in the molten metal by the pressure pin 18 during pressurization. However, in the present invention, the solidified metal pieces are removed into the cavity portion when the pressure pin causes molten metal to overflow and are removed by machining after molding.

With the second embodiment of the present invention, as illustrated in FIG. 6, a plurality of pressure pins 18 are arranged in the molding cavity 6, for example, in portions of the molding cavity corresponding to thick portions of the cast product. The molten metal in the molding cavity 6 is pressurized by operating the plurality of pressure pins 18 in an order from a pressure pin located farthest from the gate 10 to a pressure pin located nearest to the gate 10 with a predetermined time differential between one another. The pressurization by the pressure pin 18 positioned farthest from the gate 10 may be inserted before the shut pin 16 is shut off.

If the pressure pin 18 positioned nearest to the gate 10 begins to operate before the shut pin 16 is shut, a reverse flow of the molten metal toward the molten metal retaining dome 8 may be generated. However, even if the pressure pin 18 positioned farthest from the gate 10 begins to operate before the shut pin 16 is shut, the molten metal is unlikely to flow backward into the molten metal retaining dome because of the large flow resistance. As a result, the pressure pin 18 positioned farthest from the gate 10 is operated early or first, and therefore the molten metal located farthest from the gate 10 can be pressurized before it becomes solidified. This improves the quality of the casting products, and shortens the casting cycle.

With the third embodiment of the present invention, as illustrated in FIGS. 7–12, a cross-sectional area reduced portion 40 is formed in a portion of the runner 14 connecting the interior of the molten metal retaining dome 8 to the molding cavity 6, and is more preferably formed at a position close to the molding cavity 6. In the case where the shut pin 16 is provided, the cross-sectional area reduced portion 40 is formed in a portion of the runner between the shut pin 16 and the molding cavity 6. By providing the cross-sectional area reduced portion 40, a reverse flow of the molten metal is unlikely to occur, so that a sufficient pressurization, an increase in the pressure force, and earlier timing for the pressurization are therefore possible. As a result, the quality of the casting products is improved, and the casting cycle can be shortened.

Figure 8:
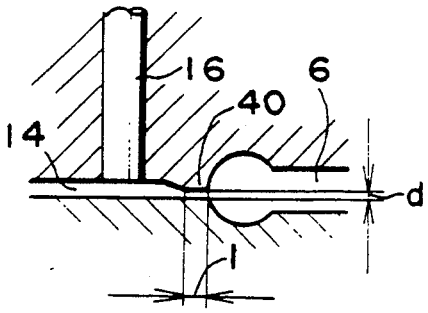
FIG. 8 is a cross-sectional schematic view of a cross-sectional area reduced portion of a runner and a vicinity thereof of the apparatus of FIG. 7.

A length, a depth, and a temperature of the cross-sectional area reduced portion 40 affect the suppression of the flowing of the molten metal backward to the molten metal retaining dome 8. In FIG. 8, the greater the length (l) of the cross-sectional area reduced portion 40 is, and the less the thickness (d) and a wall temperature of the portion 40 are, the more efficiently the molten metal is suppressed from flowing backward to the molten metal retaining dome 8. In the case where molten metal is solidified in the cross-sectional area reduced portion 40 and the solidified molten metal checks a backward flow of the molten metal, the shut pin 16 may be eliminated.

Figure 9:
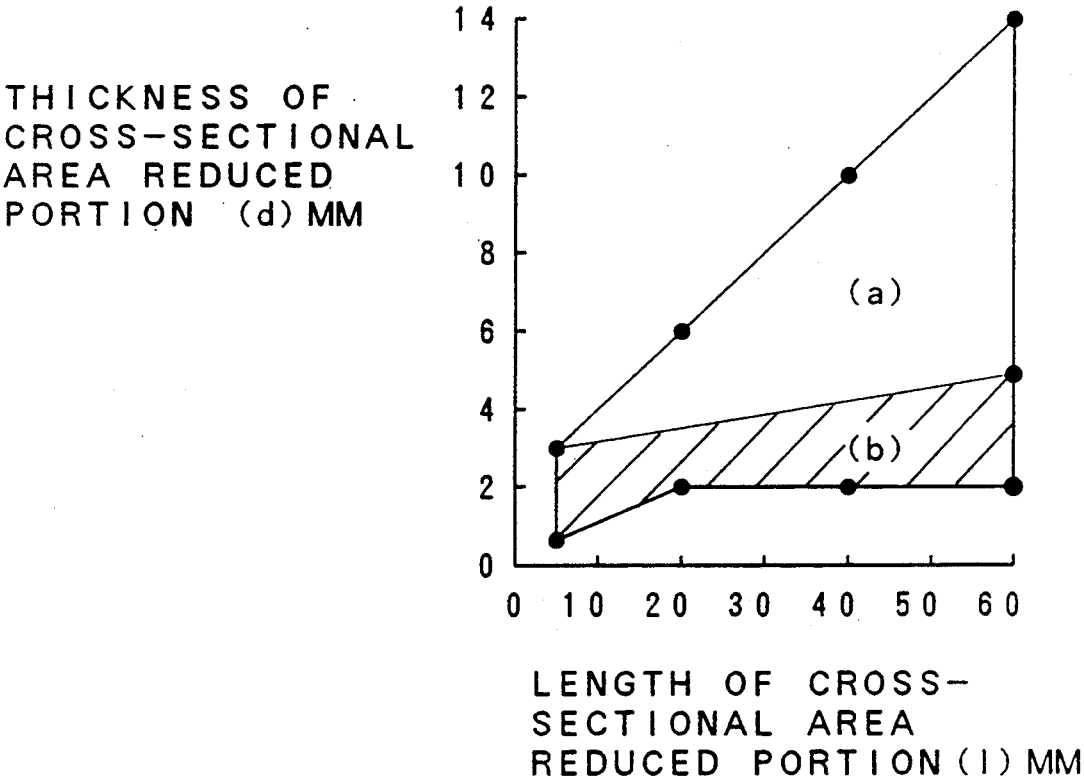
FIG. 9 is a graphical representation illustrating a relationship among a thickness, a length, and a use range of the cross-sectional area reduced portion of the runner.

FIG. 9 illustrates a relationship between the depth (d) and the length (l) of the cross-sectional area reduced portion 40, and a running characteristic of the molten metal when being charged, and a shut-off condition of the molten metal in the portion 40 after being charged. As shown in FIG. 9, in the range of (a+b), the molten metal flows smoothly when being charged, and is solidified in the portion 40 after having been charged, so that the molten metal is well checked. Especially, in the range of b, the molten metal is well checked only by solidification of the molten metal in the portion 40, so that the shut pin 16 may be eliminated. In the third embodiment of the present invention, the depth and the length of the portion 40 is selected to be in the range of (a+b).

Figure 10:
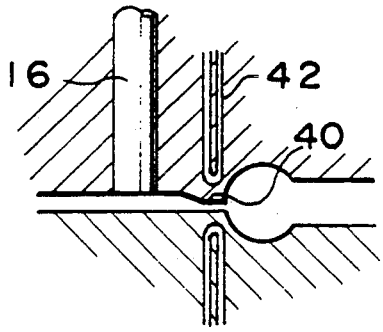
FIG. 10 is a partial cross-sectional schematic view of the apparatus of FIG. 7 where the cross-sectional area reduced portion can be cooled.
Figure 11:
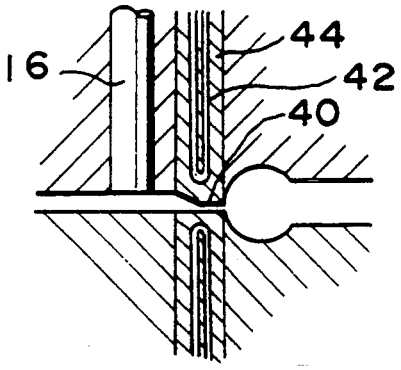
FIG. 11 is a cross-sectional schematic view of the apparatus of FIG. 7 where a portion of the die in the vicinity of the cross-sectional area reduced portion is constructed of a die portion separate from the remaining portion of the die.
Figure 12:
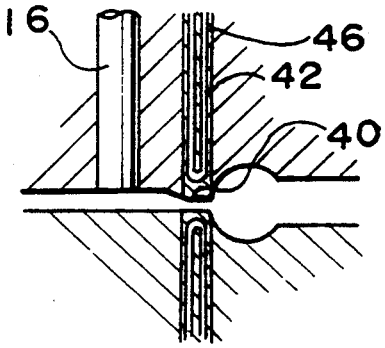
FIG. 12 is a cross-sectional schematic view of the apparatus of FIG. 7 where a portion of the die in the vicinity of the cross-sectional area reduced portion is constructed of a die portion separate from the remaining portion of the die and constructed of material having a high heat conductivity.

In the third embodiment of the present invention, as illustrated in FIG. 10, a cooling water passage 42 may be provided in a portion of the molding die in the vicinity of the cross-sectional area reduced portion 40, to cause cooling water to flow through the cooling water passage 42 so that the cross-sectional area reduced portion 40 may be cooled by the cooling water. Due to this structure, solidification of the molten metal is accelerated in the cross-sectional area reduced portion 40, and allows the portion in the vicinity of the cross-sectional area reduced portion to be designed more freely with a larger tolerance. To compensate for a delay of heat conduction from the cooling water passage 42 to the cross-sectional area reduced portion 40, it is desirable to cause cooling water to flow through the cooling water passage 42 from an early stage of the molding process. To obtain a good heat conductivity, as illustrated in FIG. 11, a die portion 44 in the vicinity of the cross-sectional area reduced portion 40 may be constructed separately from the remaining portion of the die, or, as illustrated in FIG. 12, a separate die portion 46 is made of alloy, for example copper alloy, having a high heat conductivity. Further, in FIGS. 11 and 12, to control the cooling water temperature appropriately, a heater (not shown) may be provided, in addition to the cooling water passage. As described above, by adding these thermal control means, the molten metal can flow smoothly in the molding cavity when being charged and the molten metal can be efficiently prevented from flowing backward into the molten metal retaining dome after being charged into the molding cavity.

According to the present invention, the following advantages will be obtained:

Since the pressure means is provided in a portion of the molding cavity farthest from the gate or in the vicinity thereof, the flow resistance between the pressure means and the gate is large, thereby the molten metal is suppressed from flowing backward into the molten metal retaining dome when being pressurized, and therefore at least a portion of the molten metal in the molding cavity can be pressurized at an earlier stage of the molding process. As a result, the quality of the casting products is improved and the casting cycle is shortened.

Since the molten metal in the molding cavity is pressurized by operating a plurality of pressure means arranged in the molding cavity from pressure means positioned farthest from the gate to pressure means positioned nearest to the gate with a time differential between the operation of each with respect to the others, molten metal located in the portion farthest from the gate can be pressurized before becoming solidified without generating a reverse flow of the molten metal. As a result, the quality of the casting products is improved and the casting cycle is shortened.

Since the cross-sectional area reduced portion is provided in a portion of the runner connecting the interior of the molten metal retaining dome to the molding cavity, the molten metal is prevented from flowing backward into the molten metal retaining dome when being pressurized, so that the pressure force can be increased. This allows the timing of the pressurization to occur earlier. As a result, the quality of the casting products is improved and the casting cycle is shortened.

Although only a few embodiments of the present invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A vacuum casting apparatus, comprising:

a molding cavity defined by a molding die, said molding cavity being capable of being reduced in pressure substantially to a vacuum;

means for creating a vacuum within said molding cavity;

a molten metal retaining dome for retaining molten metal to be provided to said molding cavity;

a gate provided in said molten metal retaining dome and which is closeable to isolate molten metal in said molten metal retaining dome from said molding cavity; and at least one pressure means, provided in communication with said molding cavity, for pressurizing molten metal in said molding cavity, said at least one pressure means being located at a portion of said molding cavity farthest from said gate.

2. A vacuum casting apparatus according to claim 1, wherein said at least one pressure means comprises a pressure pin which is slidable relative to said molding die and which slides into said molding cavity to pressurize said molten metal in said molding cavity.

3. A vacuum casting apparatus according to claim 1, further comprising:

a runner connecting said molten metal retaining dome to said molding cavity; and a shut pin provided in communication with said runner to shut off a flow of molten metal through said runner.

4. A vacuum casting apparatus according to claim 3, wherein said at least one pressure means is further for pressurizing said molten metal in said molding cavity not later than when said shut pin shuts off said flow of molten metal through said runner.

5. A vacuum casting method, comprising the steps of:

firstly isolating a molding cavity defined by a molding die from a molten metal retaining dome;

reducing pressure in said molding cavity substantially to a vacuum, while raising molten metal into said molten metal retaining dome;

charging said molten metal in said molten metal retaining dome into said molding cavity;

secondly isolating said molding cavity from said molten metal retaining dome;

pressurizing molten metal in said molding cavity by sequentially operating a plurality of pressure means which are spaced at various distances from said molten metal retaining dome, said sequential operation of pressure means sequentially occurring such that a first one of said pressure means located farther from said molten metal retaining dome is operated earlier than a second one of said pressure means located nearer to said molten metal retaining dome; and allowing molten metal in said molding cavity to solidify.

6. A method according to claim 5, wherein said step of pressurizing molten metal in said molding cavity includes a step of pressurizing molten metal in said molding cavity before a shut pin has completely shut off a flow of molten metal through a runner connecting said molten metal retaining dome to said molding cavity.

7. A vacuum casting apparatus, comprising:

a molding cavity defined by a molding die, said molding cavity being capable of being reduced in pressure substantially to a vacuum;

means for creating a vacuum within said molding cavity;

a molten metal retaining dome for retaining molten metal to be provided to said molding cavity;

a gate provided in said molten metal retaining dome and which is closeable to isolate said molten metal retaining dome from said molding cavity; and a runner connecting said molten metal retaining dome to said molding cavity, said runner including a first cross-sectional area and a second cross-sectional area reduced portion which is smaller than said first cross-sectional area.

8. A vacuum casting apparatus according to claim 7, wherein said molding die includes a cooling water passage formed in a portion of said molding die adjacent to said second cross-sectional area reduced portion of said runner so that said second cross-sectional area reduced portion of said runner is coolable by water passing through said cooling water passage.

9. A vacuum casting apparatus according to claim 8, wherein said portion of said molding die adjacent to said cross-sectional area reduced portion of said runner is constructed separately from a remaining portion of said molding die.

10. A vacuum casting apparatus according to claim 9, wherein said portion of said molding die constructed separately from said remaining portion of said molding die is constructed of a material having a high heat conductivity.

11. A vacuum casting apparatus according to claim 10, wherein said material having said high heat conductivity is a copper alloy.

* * * * *